US006338486B1

(12) United States Patent
Hutchens

(10) Patent No.: US 6,338,486 B1
(45) Date of Patent: Jan. 15, 2002

(54) SPORTSPOKER GAME

(76) Inventor: Randal K. Hutchens, 3228 Tanglebrook Dr., City of Belleville, County of St. Clair, IL (US) 62221

( * ) Notice: Subject to any disclaimer, the term of this patent is extended or adjusted under 35 U.S.C. 154(b) by 0 days.

(21) Appl. No.: 08/853,991

(22) Filed: May 9, 1997

(51) Int. Cl.[7] ..... A63F 1/04
(52) U.S. Cl. ..... 273/298
(58) Field of Search ..... 273/292, 298, 273/308

(56) References Cited

U.S. PATENT DOCUMENTS 2,064,466 A * 12/1936 Downey ..... 273/298 X
4,285,521 A 8/1981 Joel, III
4,546,982 A 10/1985 Gaines et al.
5,090,707 A 2/1992 Patz
5,163,688 A 11/1992 Simms
5,165,693 A * 11/1992 Handlon, Sr. ..... 273/298
5,186,467 A 2/1993 Chasin
5,201,525 A 4/1993 Castro
5,522,590 A * 6/1996 Moran ..... 273/298 X

FOREIGN PATENT DOCUMENTS

GB 2249485 6/1990

* cited by examiner

*Primary Examiner*—William E. Stoll
(74) *Attorney, Agent, or Firm*—Anthony R. Johnson

(57) ABSTRACT

The specification relates to a method of playing a game utilizing a plurality of cards, with each card corresponding to a specific event; with said method comprising the steps of distributing said cards to players of the game; viewing an actual event played on a television or other multimedia device having a series of specific events; determining when a specific event corresponds to a specific card; and scoring points when a specific event corresponds to a specific card.

14 Claims, 2 Drawing Sheets

SPORTSPOKER GAME

BACKGROUND OF THE INVENTION

1. Field of the Invention

This invention is concerned with a game that involves the players in an event, preferably a sporting event, playing on the television or other multimedia device.

2. Related Prior Art

It is known that existing games (1) simulate sporting events, such as wrestling, baseball, football, hockey, hunting and golf, (2) support trading of sports cards, and (3) test the players' trivial knowledge of sports. However, no other known game involves the players with an actual sporting event, whether live or played on a television or other multimedia device as the current invention does. Also, this invention works very well, and is ideal, for a large group of people, which is not found in existing games of any related nature.

Existing patents on games comprising the most relevant prior art known to the inventor include:

1. U.S. Pat. No. 5,201,525 issued to Castro concerns a game for trading sports trading cards and using them primarily in a game of war.
2. U.S. Pat. No. 5,186,467 issued to Chasin concerns a sports trivia and memorabilia game which tests a player's ability to recall players on famous sports teams.
3. U.S. Pat. No. 5,163,688 issued to Simms concerns a card game that simulates a wresting match.
4. U.S. Pat. No. 5,090,707 issued to Patz concerns a card game that simulates a deer hunt.
5. UK Patent Application 2,249,485 filed by Attree concerns a card game that simulates a game of golf.
6. U.S. Pat. No. 4,285,521 issued to Joel, III concerns a card game that simulates a game of football.
7. U.S. Pat. No. 4,546,982 issued to Gaines et al. concerns a card game that simulates a game of golf.

SUMMARY OF THE INVENTION

A primary object of the present invention is to provide an improved game that will overcome the shortcomings of the prior art inventions.

An object of this invention is to provide an improved game that involves the players with an actual sporting event, said event being either live or preferably played on a television or other multimedia device.

Another object of this invention is to provide an improved game that has a playing option for an individual as well as small and very large groups.

It is an object of this invention to provide an improved game that has an ideal playing option for a large group of people.

It is an object of this invention to provide an improved game that may be used for any type of sporting event that is viewed on the television or other multimedia device.

Further objects of the invention will appear as the description proceeds.

To accomplish the above and related objects, this invention may be embodied in the form illustrated in the accompanying drawings, attention being called to the fact, however, that the drawings are illustrative only, and that changes may be made in the specific construction illustrated and described within the scope of the appended claims.

In accordance with a first embodiment of the invention, the invention presents a method of playing a game utilizing a plurality of cards, with each card corresponding to a specific event; said method comprising the steps of: distributing said cards to players of the game; viewing an actual event having a series of specific events; determining when the viewing time begins; determining when a specific event corresponds to a specific card during the viewing time; and scoring points when a specific event corresponds to a specific card.

BRIEF DESCRIPTION OF THE DRAWINGS

The drawings illustrate the best mode presently contemplated of carrying out the present invention.

Figure 1:
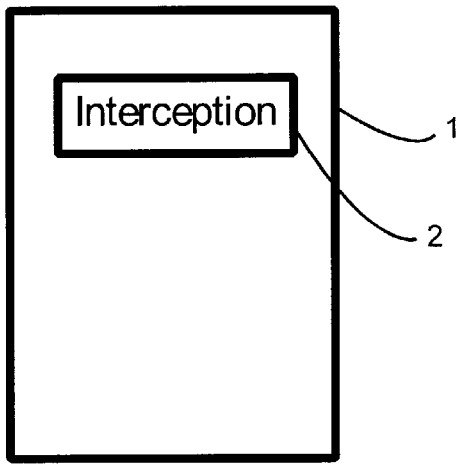
FIG. 1 illustrates the face of a Playing Card 1 corresponding to a Specific Event 2 which only states a Specific Event 2.
Figure 2:
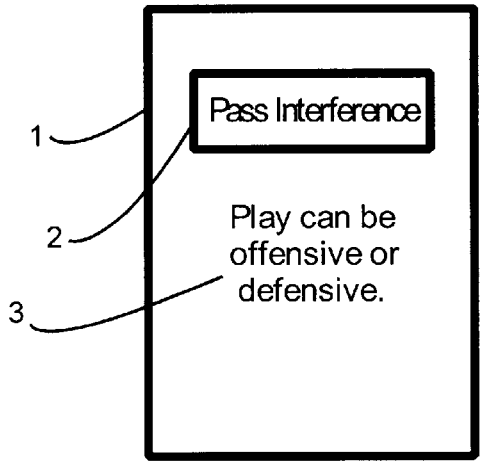
FIG. 2 illustrates the face of a Playing Card 1 corresponding to a Specific Event 2, which states a Specific Event 2 and Instructions 3.
Figure 3:
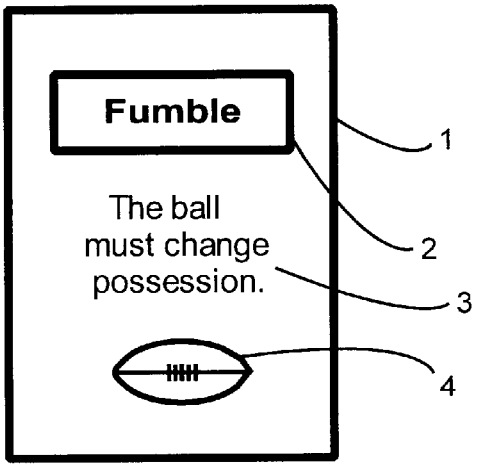
FIG. 3 illustrates the face of a Playing Card 1 corresponding to a Specific Event 2, which states a Specific Event 2 and Instructions 3, and shows a Picture 4 of the Specific Event 2.
Figure 4:
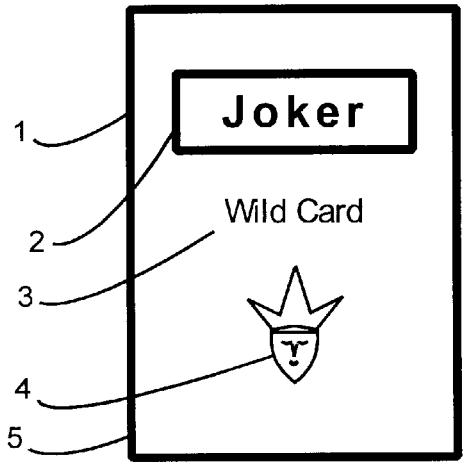
FIG. 4 illustrates the face of a Joker Playing Card 5.
Figure 5:
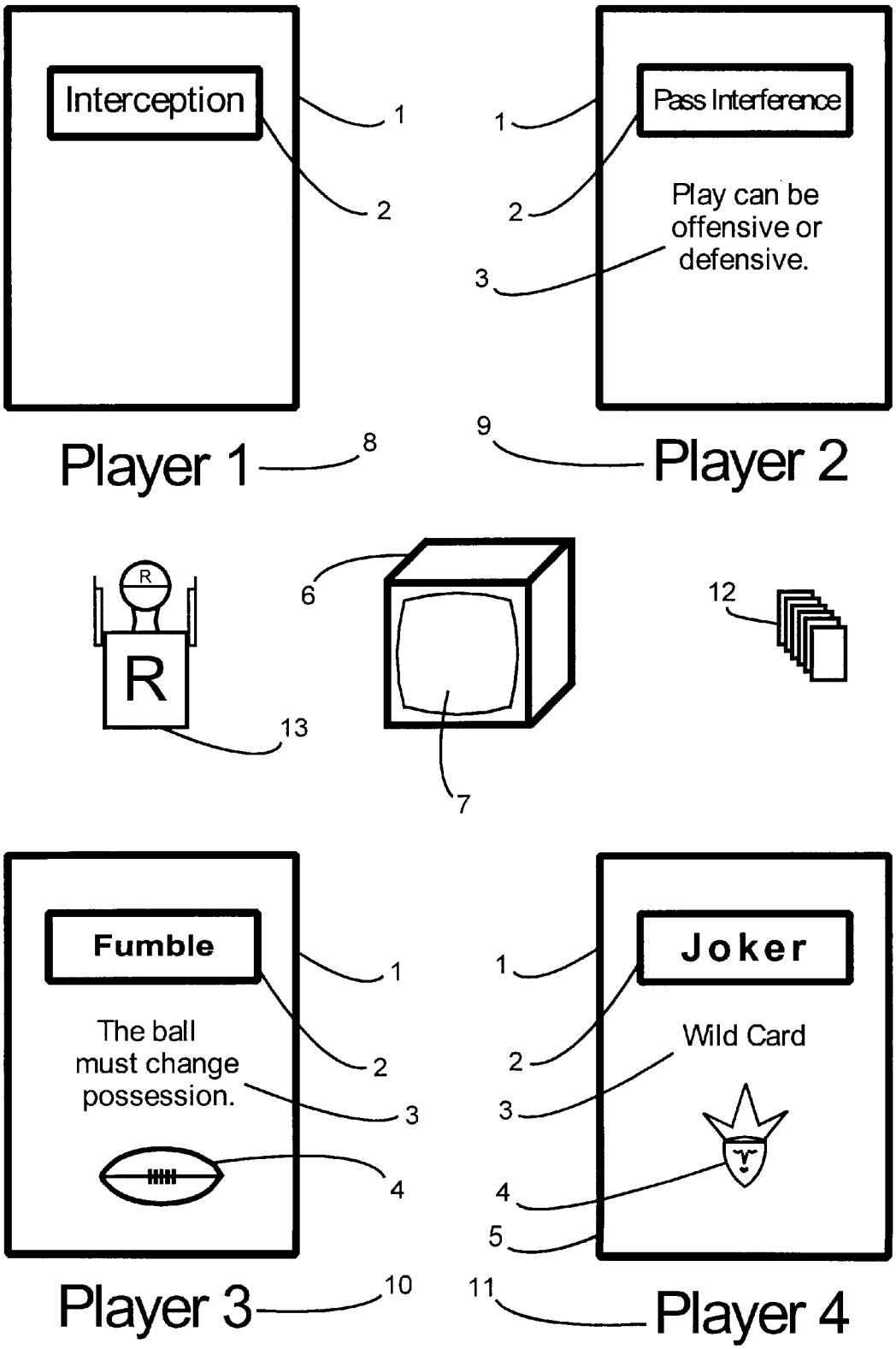
FIG. 5 illustrates the layout of the preferred embodiment of the game.

In the drawings, the following designations are shown and referred to in this pecification:

Playing Card 1
Specific Event 2
Instructions 3
Picture 4
Joker Card 5
Television or Other Multimedia Device 6
Actual Event 7
Player One 8
Player Two 9
Player Three 10
Player Four 11
Plurality of Playing Cards 12
Referee 13

DESCRIPTION OF THE PREFERRED EMBODIMENT(s)

The specification relates to both a game and to a method for playing the game, with the method for playing the game representing the primary disclosure of the specification. In general, the specification relates to a game comprising a plurality of cards, with each card corresponding to a specific event; a means for distributing said cards to players of the game; access to an actual sporting event having specific events; and a means for scoring when a specific event corresponds to a card. In addition, the specification relates more prominently to a method of playing a game utilizing a plurality of cards, with each card corresponding to a specific event; with said method comprising the steps of distributing said cards to players of the game; viewing an actual event played on a television or other multimedia device having a series of specific events; determining when a specific event corresponds to a specific card; and scoring points when a specific event corresponds to a specific card.

In the preferred embodiment of the game, a Plurality of Playing Cards 12 are used. Each Playing Card 1 corresponds to a Specific Event 2. Preferably, each Playing Card 1 may have up to three types of markings on them, namely: the name of the Specific Event 2, Instructions 3 and / or a Picture 4. The Specific Event 2 names the specific event corresponding to that particular Playing Card 1. The Instructions 3 may define, limit or explain the Specific Event 2. The Picture 4 represents the Specific Event 2 graphically. For a particular variation of the game, the Plurality of Playing Cards 12 may have individual Playing Cards 1, 12 having just the name of the Specific Event 2, both the name of the Specific Event 2 and Instructions 3, or all three items of the name of the Specific Event 2, Instructions 3 and a Picture 4.

The game is preferably played by first distributing Playing Cards 1, 12 to each player of the game. The game could be played with as few as one person, who gives himself or herself a set time period to score. Alternatively and preferably, the game is played by a large group, limited only by the number of Playing Cards 1, 12.

After the Playing Cards 1, 12 are distributed, the players must gain access to an Actual Event 7. Preferably the Actual Event 7 is viewed on a Television or Other Multimedia Device 6. The Actual Event 7 is preferably a live event, but it could be taped, manufactured or otherwise produced and subsequently viewed. The Actual Event 7 would consist of a series of specific events which would correspond with the Specific Events 2 represented on the Playing Cards 1, 12.

Some means must be provided for determining when the viewing time begins. When the viewing time begins, the players watch the Actual Event 7 waiting and determining if and when their Specific Event 2 occurs. There must be some means of determining, then, when a Specific Event 2 corresponds to a Specific Event 2 listed on a specific Playing Card 1. When a determination is made that a Specific Event 2 corresponds to a Specific Event 2 listed on a specific Playing Card 1, then points are awarded for such a correspondence.

To further the game, the steps of the game are repeated until the determined ending is achieved, which may vary as in most games. The end may be achieved when a certain player reaches a certain amount of points, or after a certain period of time.

Other embodiments of the game exist, which may or may not represent variations of the game. In the preferred embodiment of the game, the Actual Event 7 is a sporting event shown on a Television or other Multimedia Device 6. The actual sporting event may be one of the following sporting events: football, baseball, basketball, hockey, golf, volleyball, wrestling, boxing, tennis or other sporting event. However, the specific embodiment of the game is not limited to sporting events and may relate to any Actual Event 7 having a series of Specific Events 2.

The embodiment of the game may include one or more Joker Card(s) 5. Preferably, the Joker Card 5 is designated as any Specific Event 2 relevant to the Actual Event 7 being viewed. Some means for determining the Specific Event 2 corresponding to the Joker Card 5 must exist, and such a determination is preferably made prior to the beginning of the viewing time. Such a determination could be made by the player holding the Playing Card 1, a designated player or a Referee 13. The Referee 13, if used, is a person who does not receive any Playing Cards 1, but only makes certain determinations, which may include what Specific Event corresponds to the Joker Card 5 for a given viewing time, the start of the viewing time and whether any Actual Event 7 corresponds to a Specific Event 2.

In one embodiment of the game, each player would receive as many Playing Cards 1, 12 as possible so that each player receives the same number of Playing Cards 1, 12. In such an embodiment, either a designated player, which may be the dealer, or a Referee 13 may announce the start of the viewing time.

As a further embodiment of the game, once the players receive their Playing Card(s) 1, 12 for a specific viewing time, and prior to the start of the viewing time, each player may discard one or two Playing Cards 1, 12 and draw the same number of Playing Cards 1, 12 to replenish his or her number of Playing Cards 1, 12. Again, such an embodiment may include the presence of one or more Joker Card(s) 5, which function as stated elsewhere herein.

In some embodiments of the game, the determination of whether any Actual Event 7 corresponds to a Specific Event 2 can be made by a Referee 13. The Referee 13, if used, is a person who does not receive any Playing Card(s) 1, 12, but only makes the determination of whether any Actual Event 7 corresponds to a Specific Event 2.

In some embodiments of the game, the determination of whether any Actual Event 7 corresponds to a Specific Event 2 can be made by a majority vote of the players.

In one embodiment of the game, the Specific Events 2 named on the Playing Cards 1, 12 include the following Specific Events 2 relevant to a football game:

1. Interception;
2. Fumble;
3. Fumble (possession must change);
4. Pass Interference (offensive or defensive);
5. Touchdown by Passing Play;
6. Touchdown by Running Play;
7. Field Goal Attempted;
8. Field Goal Made;
9. Fourth Down Conversion;
10. Offside or False Start (need not be accepted by opposing team);
11. On-Side Kick Attempt (need not be recovered by kicking team);
12. Holding or Illegal Use of Hands;
13. Face Mask;
14. Unsportsmanlike Conduct or Personal Foul;
15. Kickoff or Punt Returned for a Touchdown (wins over a "Kickoff or Punt Returned Past the 50 Yard Line" or "Touchdown by Running Play");
16. Clipping or Illegal Block;
17. Score by Defense (wins over "Touchdown by Running Play" or "Interception" or "Fumble" or "Quarterback Sack");
18. Quarterback Sack;
19. Quarterback Scrambles for First Down (wins over "Fourth Down Conversion");
20. Player says or mouths, "Hi Mom!";
21. Kickoff or Punt Returned Past the 50 Yard Line;
22. Delay of Game;
23. Fake Punt or Field Goal Converted to First Down or Touchdown;
24. Missed Field Goal Attempt;
25. Blocked Punt or Field Goal Attempt (wins over "Missed Field Goal Attempt"); and
26. Joker.

In one embodiment of the game, the Specific Events 2 named on the Playing Cards 1, 12 include the following Specific Events 2 relevant to a baseball game:

1. Called Third Strike;
2. Base on Balls (does not include intentional walk);
3. Intentional Walk;
4. Batter Hit by Pitch;
5. Stolen Base (runner must be safe);
6. Bunt (must be fair ball);
7. Home Run;
8. Double Play;
9. Fly Ball Caught by Center Fielder;
10. Wild Pitch or Passed Ball;
11. Error by Defensive Player;
12. Line Drive Caught by Infielder;
13. Player Taken Out of Game in Middle of Inning (includes pitcher);
14. Runner Thrown Out Trying to Steal a Base;
15. Runner Picked Off by Pitcher or Catcher;
16. Pinch-Hitter or Designated Hitter Gets a Base Hit;
17. Pop-Up (must be caught by an infielder);
18. Single;
19. Double;
20. Triple;
21. RBI Single;
22. RBI Double;
23. RBI Triple; and
24. Joker.

In one embodiment of the game, the Specific Events 2 named on the Playing Cards 1, 12 include the following Specific Events 2 relevant to a basketball game:

1. Three Point Basket;
2. Slam Dunk;
3. Double-Dribble or Traveling;
4. Technical Foul;
5. Player or Coach Ejected From Game (wins over "Technical Foul");
6. Hook Shot (must be made);
7. Goal Tending;
8. Player Falls or Jumps Into Seated Fans;
9. Tip-In;
10. Illegal Defense;
11. Turn-Over Resulting From Bad Pass, Steal or Ball Going Out of Bounds;
12. Behind the Back Pass;
13. Time Out (called by team or official);
14. Shooter Gets His Own Rebound;
15. Blocked Shot (no foul);
16. Missed Free-Throw;
17. Shot Made at the Buzzer or Expiration of Shot Clock (wins over "Three Point Basket");
18. Offensive Foul;
19. Player Fouls Out;
20. Shot Clock Expires;
21. Three Second Violation; and
22. Joker.

Having set forth the general nature and specific embodiments of the present invention, the true scope is now particularly pointed out in the appended claims.

What is claimed is:

1. A method of playing a game utilizing a plurality of cards, with each card corresponding to a specific event;

said method comprising the steps of:

distributing said cards to players of the game;

viewing an actual event having a series of specific events;

determining when the viewing time begins;

determining when a specific event corresponds to a specific card during the viewing time; and scoring points when a specific event corresponds to a specific card.

2. The method of playing the game according to claim 1 wherein the step of viewing is viewing a sporting event on a television or other multimedia device.

3. The method of playing the game according to claim 2 wherein a joker card is used that may be designated as any relevant specific event prior to the viewing time by the designated player.

4. The method of playing the game according to claim 3 wherein a non-player is selected as a referee to determine when a specific event corresponds to a specific card during the viewing time.

5. The method of playing the game according to claim 3 wherein the players vote on a majority basis to determine when a specific event corresponds to a specific card during the viewing time.

6. The method of playing the game according to claim 2 wherein one to three cards are dealt to each player, depending on the number of players and number of available cards, so that each player has the same number of cards; and a designated player announces the start of the viewing time.

7. The method of playing the game according to claim 6 wherein a non-player is selected as a referee to determine when a specific event corresponds to a specific card during the viewing time.

8. The method of playing the game according to claim 6 wherein the players vote on a majority basis to determine when a specific event corresponds to a specific card during the viewing time.

9. The method of playing the game according to claim 2 wherein one to three cards are dealt to each player, depending on the number of players and number of available cards, so that each player has the same number of cards; and each player is allowed to discard one or two cards and draw the same number of cards before the viewing time begins; and a designated player announces the start of the viewing time.

10. The method of playing the game according to claims 9 wherein a joker card is used that may be designated as any relevant specific event prior to the viewing time by the designated player.

11. The method of playing the game according to claim 9 wherein a non-player is selected as a referee to determine when a specific event corresponds to a specific card during the viewing time.

12. The method of playing the game according to claim 9 wherein the players vote on a majority basis to determine when a specific event corresponds to a specific card during the viewing time.

13. The method of playing the game according to claim 2 wherein a non-player is selected as a referee to determine when a specific event corresponds to a specific card during the viewing time.

14. The method of playing the game according to claim 2 wherein the players vote on a majority basis to determine when a specific event corresponds to a specific card during the viewing time.

* * * * *